United States Patent [19]

Aller et al.

[11] 3,980,212

[45] Sept. 14, 1976

[54] HOPPER UNLOADING SYSTEM

[75] Inventors: Edmund R. Aller, Portage; Richard W. Arndt, Michigan City, both of Ind.

[73] Assignee: General American Transportation Corporation, Chicago, Ill.

[22] Filed: Nov. 20, 1974

[21] Appl. No.: 525,364

[52] U.S. Cl. ..... 222/485; 137/625.4; 137/625.48; 302/52

[51] Int. Cl.[2] ..... B65G 53/40

[58] Field of Search ..... 302/27, 36, 39, 40, 302/42, 52; 137/625.4, 625.48; 222/266, 270, 279, 476, 485, 486; 214/83.2, 83.28; 105/283, 287, 289, 296, 299; 74/503

[56] References Cited

UNITED STATES PATENTS

| | | | |
|---|---|---|---|
| 1,016,415 | 2/1912 | Jorn | 302/42 X |
| 1,573,380 | 2/1926 | Evans | 74/503 X |
| 3,194,420 | 7/1965 | Kemp | 302/52 X |
| 3,207,560 | 9/1965 | Brown | 302/52 |
| 3,314,575 | 4/1967 | Graham | 222/485 X |
| 3,391,837 | 7/1968 | Liebenthal | 222/485 |
| 3,632,174 | 1/1972 | Miller | 302/52 X |
| 3,637,262 | 1/1972 | Adler | 302/52 |
| 3,778,114 | 12/1973 | Carney | 302/52 |
| 3,874,569 | 4/1975 | Fossett | 302/52 X |
| 3,876,261 | 4/1975 | Jucius | 302/52 |

*Primary Examiner*—Evon C. Blunk
*Assistant Examiner*—James L. Rowland
*Attorney, Agent, or Firm*—Prangley, Dithmar, Vogel, Sandler & Stotland

[57] ABSTRACT

An unloading system for granular lading comprising a hopper having four cells each with a discharge opening in the lower portion thereof, a discharge tube below the hopper and communicating with each of the openings, two part-tubular sliders within the discharge tube in general longitudinal arrangement with each adjacent to two of the openings, each of the sliders being independently shiftable longitudinally within the discharge tube between a storage position and one of two discharge positions, and a handle for each of said sliders extending to one end of the hopper for controlling the slider from the one end of the hopper; there also is disclosed an end cap for the discharge tube securable thereto and holding the handles in the storage positions thereof, a slide rod being provided on the hopper to hold the end cap when it is disengaged from the discharge tube.

19 Claims, 8 Drawing Figures

106
108
120
127
128
130
131
135
136
137
138
139
140
141
142
143
146
148
149
150
151
153
154
156
157
158
159
116
117
118
119
8.

HOPPER UNLOADING SYSTEM

BACKGROUND OF THE INVENTION

The present invention relates generally to improvements in unloading systems for hoppers, and specifically to unloading systems for hoppers adapted to carry granular lading such as plastic pellets that tend to collect in and jam the unloading system.

Hopper unloading systems provided heretofore all have a valve disposed between the hopper and a discharge tube that is adapted to be connected to a source of air under pressure or to a source of reduced pressure or vacuum. Such valves all include a movable valve member which selectively opens and closes an opening between the hopper and the discharge tube.

One form of such prior structure is illustrated in U.S. Pat. No. 2,650,726 granted Sept. 1, 1953 to Edmund R. Aller et al. That patent utilized a rotary valve member to open and close the opening between the hopper and the discharge tube. Although perfectly satisfactory for most forms of lading, it was found that granular materials such as plastic pellets tend to collect in the space between the stationary valve member and the rotary valve member, and tend to wedge the parts so tightly that the rotary valve member cannot be moved.

The same type of problem is encountered when sliding valve members are utilized rather than the rotary valve members described above. An example of a sliding valve member is illustrated in U.S. Pat. No. 3,207,560 granted Sept. 21, 1965 to Wilbur A. Brown. Granular material such as plastic pellets also tend to jam or wedge these sliding valves because the pellets tend to collect in the space at the bottom of the discharge tube between the movable valve member and the discharge tube, these particles wedging so tightly that the movable valve member cannot be moved. Attention is also directed to U.S. Pat. No. 3,637,262 granted Jan. 25, 1972 to Franklin P. Adler which shows a similar arrangement.

These prior unloading systems also had the disadvantage that granular material remained wedged in the valve structure after unloading of the lading from the hopper and such retained granular material was often discharged into the next lading thus to contaminate subsequent lading. Certain of the prior unloading systems also allowed leakage of air into or out of the system or entry of dirt or water into the interior of the system during the unloading, all of which is objectionable.

SUMMARY OF THE INVENTION

The present invention provides an unloading system which eliminates jamming thereof by granular material, which requires far less force to operate between the storage and discharge positions thereof, which substantially prevents leakage of air into or out of the system or entry of dirt or water into the system, and which is lighter in weight and less expensive.

This is accomplished in the present invention, and it is an object of the present invention to accomplish these desired results, by providing a hopper having a discharge opening in the lower portion thereof, a discharge tube disposed below the hopper and communicating intermediate its ends with the opening in the hopper for receiving granular lading from the hopper, a part-tubular slider mounted within the discharge tube and confined in the upper portions thereof and adjacent to the opening, the slider being shiftable longitudinally within the discharge tube between a storage position covering the opening and a discharge position uncovering at least a portion of the opening, and a mechanism for moving the slider between the storage position and the discharge position.

Another object of the invention is to provide an unloading system of the type set forth wherein the slider is mounted upon support structure extending from the discharge tube and carrying the lower edges of the slider, the outer surface of the slider being preferably out of contact with the inner surface of the discharge tube throughout the adjacent areas thereof.

Yet another object of the invention is to provide an unloading system of the type set forth wherein the slider can be disconnected from the control mechanism therefore and longitudinally removed from the discharge tube for repair and replacement.

Another object of the invention is to provide an unloading system of the type set forth wherein the slider is controlled by a handle mounted adjacent to one end of the discharge tube, and an end cap is provided for the one end and securable thereto for closing the one end and for holding the handle in a position to maintain the slider in the storage position thereof.

Yet another object of the invention is to provide an unloading system of the type set forth for use in a hopper having two separate cells each having discharge openings into the discharge tube, a single slider being provided and movable between a storage position closing both discharge openings and one of two discharge positions in which one of the two hopper cells is connected to the discharge tube for discharge positions.

Still another object of the invention is to provide an unloading system of the type set forth wherein the hopper has four separate cells each having a discharge opening into the discharge tube, and two sliders are provided, each associated with two of the four hopper cells for controlling a discharge of granular lading therefrom.

In connection with the foregoing, it is another object of the invention to provide an unloading system wherein a handle is provided for each of the sliders and disposed adjacent to one end of the hopper, and an end cap is provided for the one end of the discharge tube and securable thereto for closing the one end and for holding both handles in a position to maintain the sliders in the storage positions thereof.

A further object of the invention is to provide in an unloading system of the type set forth an end cap and a support structure for holding the end cap on the hopper and off the ground when the end cap is disconnected from the associated discharge tube.

Further features of the invention pertain to the particular arrangement of the parts of the unloading system, whereby the above outlined and additional operating features thereof are attained.

The invention, both as to its organization and method of operation, together with further features and advantages thereof will best be understood with reference to the following specification taken in connection with the accompanying drawings.

DESCRIPTION OF THE PREFERRED EMBODIMENTS

Figure 1:
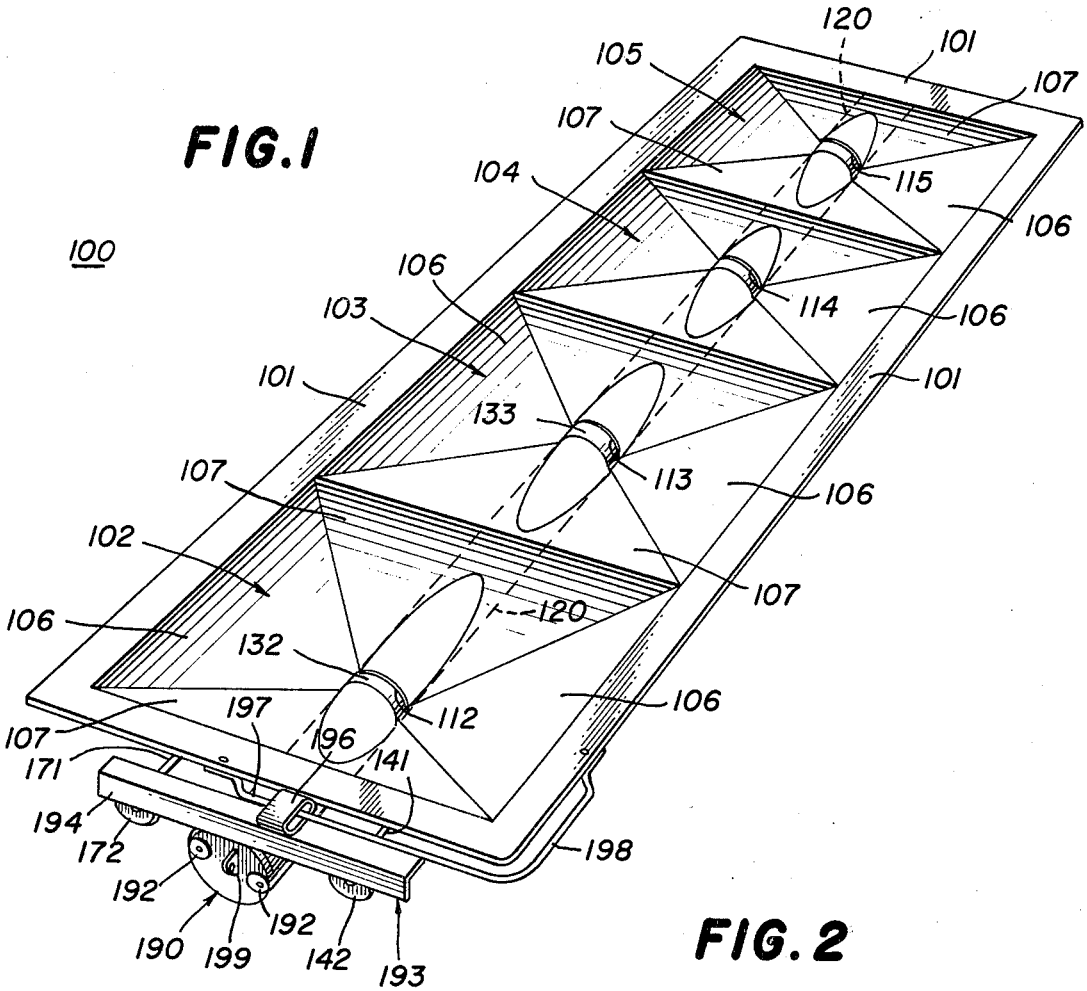
FIG. 1 is a perspective view from the top of a first preferred embodiment of a hopper made in accordance with and embodying the principles of the present invention, the end cap for the discharge tube being shown in the operative closing position thereof.
Figure 2:
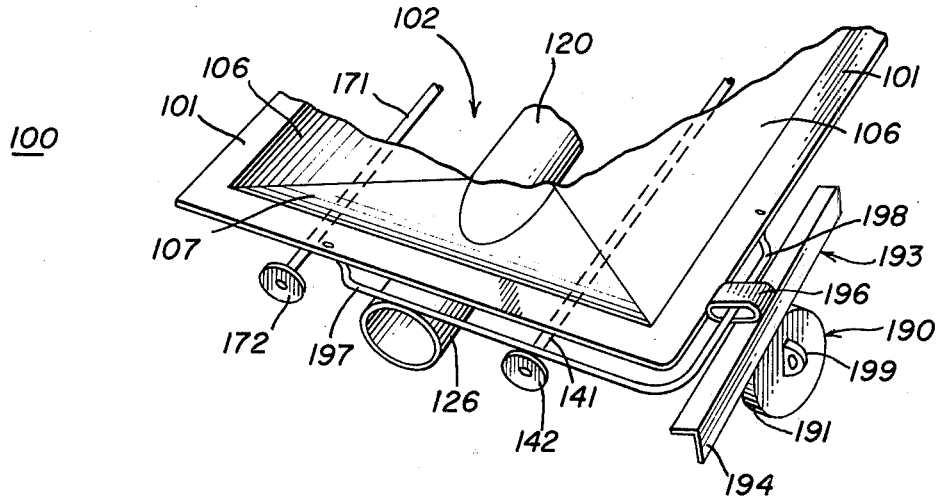
FIG. 2 is a fragmentary view of the lower end of FIG. 1 showing the end cap removed and shifted to the unloading position thereof.
Figure 3:
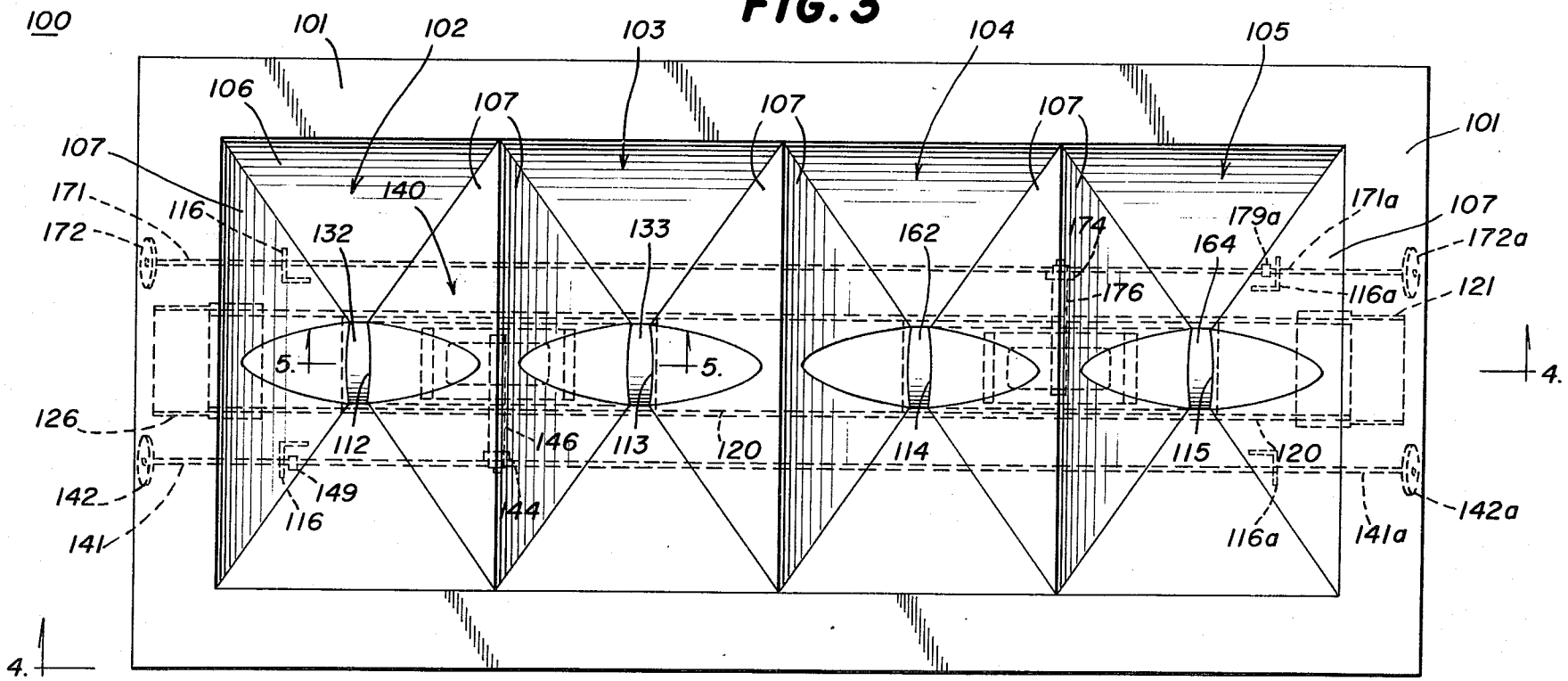
FIG. 3 is a plan view of the hopper of FIG. 1.
Figure 4:
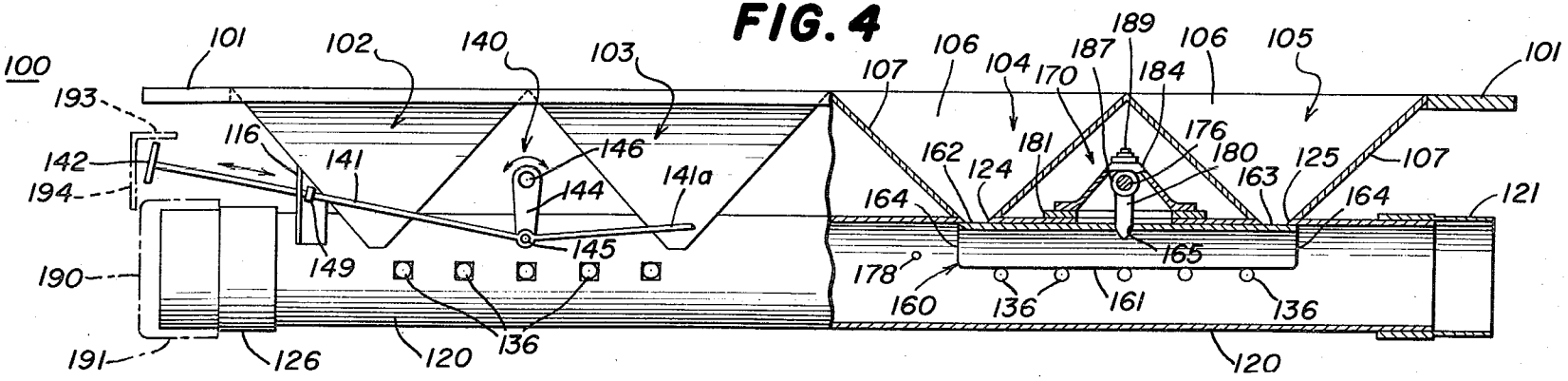
FIG. 4 is a side view of the hopper of FIGS. 1 and 3 with a portion broken away along the line 4—4 of FIG. 3 to illustrate one of the sliders.
Figure 5:
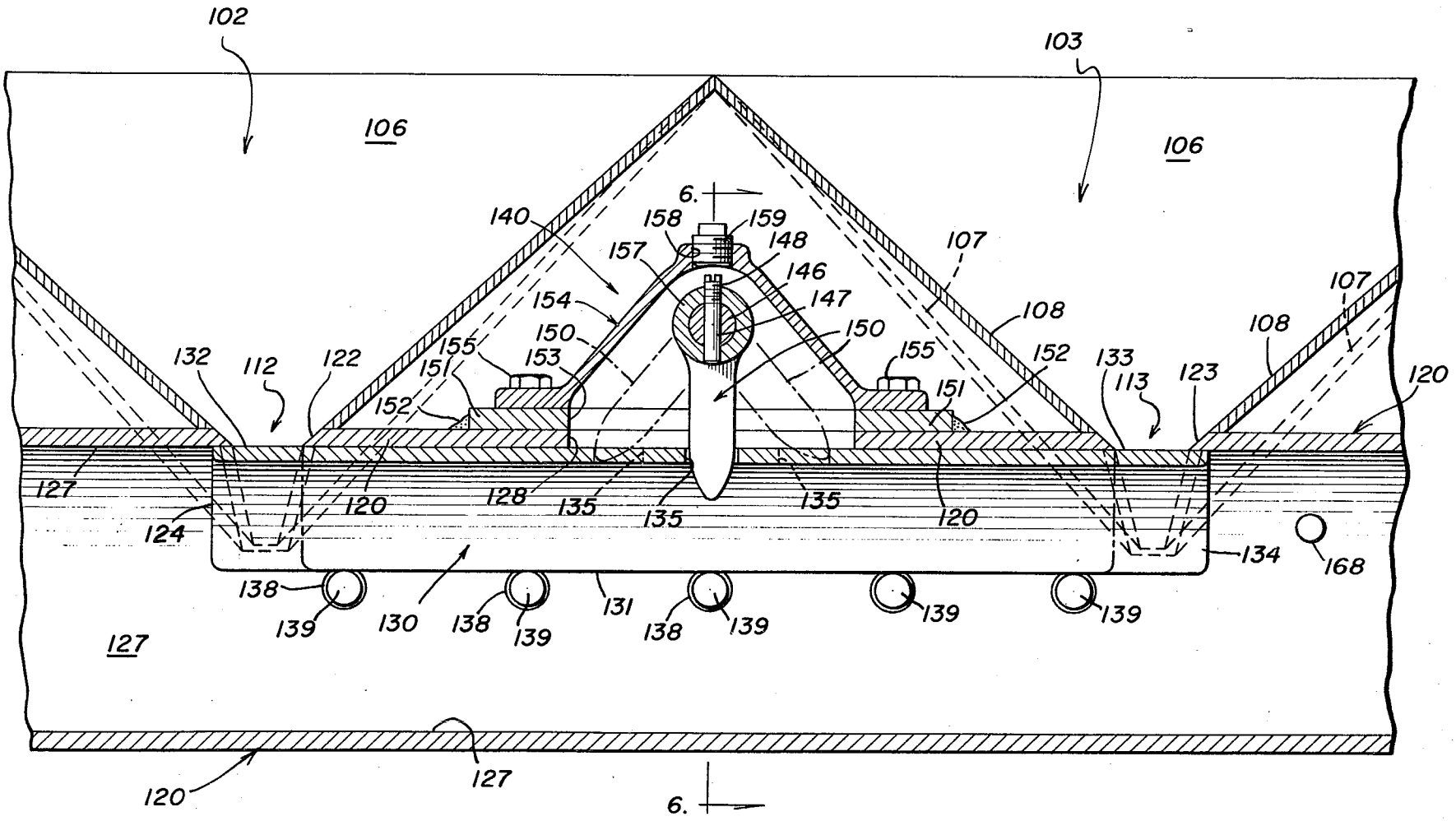
FIG. 5 is a fragmentary view on an enlarged scale in vertical section along the line 5—5 of FIG. 3.

There is illustrated in FIGS. 1 through 6 of the drawings a preferred embodiment of an unloading system particularly useful in connection with a hopper handling granular material, such as plastic pellets. In the drawings, there is shown a hopper generally designated by the numeral 100 having a top mounting flange 101 extending therearound and defining a rectangular area within which there are disposed four hoppers or cells 102, 103, 104 and 105. Each of the cells 102 through 105 is provided with slanting side walls 106 and sloping transverse walls 107 that converge downwardly and define therebetween openings 112, 113, 114 and 115 in the cells 102 through 105, respectively. In order to improve the discharge characteristics of each of the cells, the transverse walls 107 are each provided with a raised portion 108 that is best illustrated in FIGS. 3 and 5 of the drawings.

Disposed below the hopper 100 is a discharge tube 120 that is generally circular in cross section and is provided with a first coupling or end sleeve 121 at the right-hand end thereof, as viewed in FIG. 3, and a second coupling or end sleeve 126 connected to the left-hand end, as viewed in FIG. 3. The end sleeves 121 and 126 are identical in structure and function, one in use being connected to a source of compressed air or vacuum and the other to a discharge conduit, or vice versa. Disposed between the ends of the discharge tube 120 are four holes 122 through 125 that are associated respectively with the openings 112 through 115 in the cells 102 through 105. The aligned openings and holes permit passage of granular material from the cells into the interior of the discharge tube 120 and against the interior surface 127 thereof.

Disposed within the discharge tube 120 is a first slider 130 for controlling the flow of granular material from the cells 102 and 103 into the discharge tube 120, and a second slider 160 for controlling the discharge of granular material from the cells 104 and 105 into the discharge tube 120.

Figures 6, 7, 8:
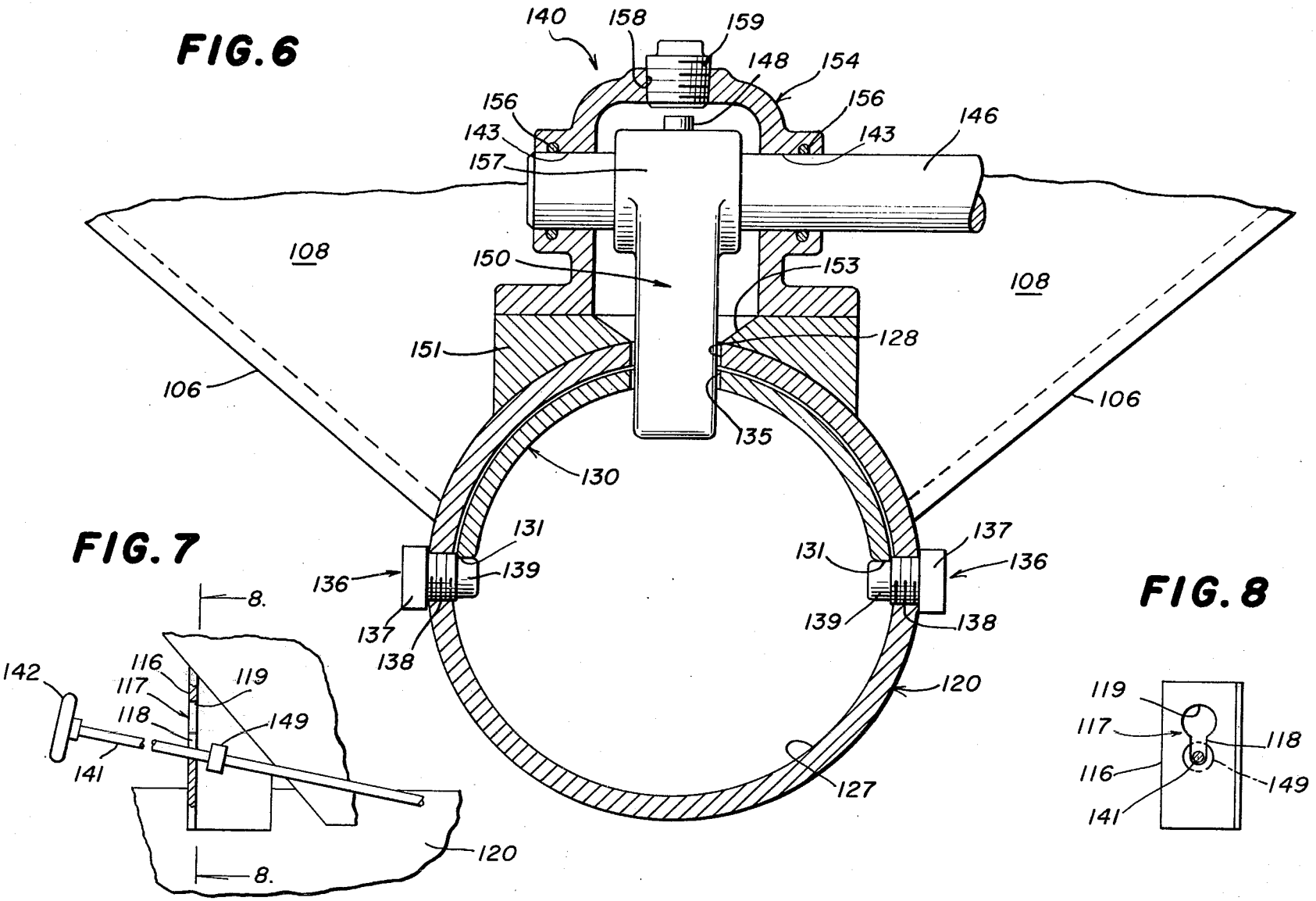
FIG. 6 is a further enlarged fragmentary view in vertical section along the line 6—6 of FIG. 5.
FIG. 7 is a fragmentary view in side elevation of a part of the slide actuator mechanism.
FIG. 8 is a fragmentary view in section along the line 8—8 of FIG. 7.

Referring particularly to FIGS. 5 and 6 of the drawings, the construction of the first slider 130 is there illustrated, wherein it will be seen that the slider 130 is essentially part-circular in transverse cross section and has a length such that it can cover both the opening 112 for the hopper 102 and the opening 113 for the hopper 103 when in its centered or storage position, as illustrated by solid lines in FIG. 5. More specifically, the left-hand end 132 of the slider 130 closes the opening 112, while the right-hand end 133 of the slider 130 closes the opening 113. Each of the end edges of the slider 130 is beveled as at 134, while the longitudinal edges 131 are formed substantially flat.

The slider 130 is supported within the discharge tube 120 by two rows of studs 136 which are of the "dog-point" type, each row containing five of the studs 136. From FIG. 6, it will be seen that each of the studs 136 includes an enlarged head 137 disposed outside of the discharge tube 120, a threaded shank 138 having a diameter slightly less than that of the head 137 and threadedly engaging a threaded opening in the side wall of the discharge tube 120, and a smooth shank 139 of a diameter less than that of the threaded shank 138. The lower edges 131 of the slider 130 rest upon and are carried by the smooth shanks 139 on the studs 136. Preferably, the radius of curvature of the outer surface of the slider 130 is slightly less than the radius of curvature of the inner surface 127 of the discharge tube 120 so that the outer surface of the slider 130 is spaced a few thousandths of an inch away from the inner surface 127 of the discharge tube 120. Preferably also, the threaded shanks 138 extend inwardly beyond the inner surface 127 of the discharge tube 120 so as to center the slider 130 transversely with respect to the discharge tube 120. As a result of this construction, the outer surface of the slider 130 facing the inner surface 127 of the discharge tube 120 is spaced therefrom throughout the entire facing areas thereof.

An actuator mechanism 140 is provided to control the position and movement of the slider 130 within the discharge tube 120 and with respect to the openings 112 and 113 in the hopper cells 102 and 103, respectively. Referring to FIGS. 1 to 4, there is provided a handle 141 for the slider 130, the handle 141 having a knob 142 at the end thereof that is disposed adjacent to the left-hand end of the hopper 100 and adjacent to the end coupling 126. The other end of the handle 141 is connected to a lever arm 144 by a pivot connection 145, the handle 141 passing through and being supported by a bracket 116, see FIGS. 7 and 8 also. The lever arm 144 is mounted on a shaft 146 that extends transversely with respect to the hopper 100 and carries thereon an actuating lever 150. Referring specifically to FIGS. 5 and 6 of the drawings, it will be seen that the shaft 146 is rotatably mounted in a housing 154 mounted in a space at the bottom of the hopper 100 provided by two of the transverse walls 107. More specifically, a mounting plate 151 is provided on the top of the discharge tube 120 and is secured thereto as by welds at 152, the mounting plate 151 having an opening 153 that communicates with a slot 128 in the top of the discharge tube 120. The housing 154 is secured to the mounting plate 151 by bolts 155 in position such that the shaft 146 extends into and through the housing to be supported by two bearings 143 formed in the housing 154, O-ring 156 being provided to form a seal between the shaft 146 and the bearings 143. The actuating lever 150 has a hub 157 receiving the shaft 146 therethrough, a pin 147 having a threaded end 148 extending through aligned openings in the hub 157 and the shaft 146 fixedly to secure the actuating lever 150 on the shaft 146. Access to the interior of the housing 154 is had through an opening 158 that is typically closed by a threaded plug 159. There is provided a stop 168 extending inwardly from the wall of the discharge tube 120 to limit longitudinal movement of the slider 130 into the discharge tube 120.

The slider 130 has a square hole 135 in its top center, see FIG. 5, that receives the actuating lever 150 extending downwardly thereinto. The actuating lever 150 can be oscillated by means of the actuator mechanism 140 including the knob 142, the lever arm 144 and the shaft 146 carrying the actuating lever 150. Thus by turning the shaft 146 about 45° each way from its center position, the slider 130 is moved in one direction to uncover the discharge opening 112 for the hopper cell 102 or is moved in the other direction to uncover the discharge opening 113 for the hopper cell 103. It will be understood that the openings 112 and 113 can be fully uncovered by turning the shaft 146 a full 45° or can be partially uncovered by turning the shaft 146 less than 45°.

Referring now to FIGS. 3 and 4 of the drawings, the construction of the second slider 160 is illustrated. The second slider 160 is also essentially part-circular in transverse cross section and has a length such that it can cover both the opening 114 for the hopper 104 and the opening 115 for the hopper 105 when it is centered or in its storage position, as illustrated in FIG. 4. More specifically, the left-hand end 162 of the slider 160 closes the opening 114, while the right-hand end 163 of the slider 160 closes the opening 115. Each of the end edges 164 of the slider 160 is beveled like the end edges 134 described above, while the longitudinal edges 161 are formed substantially flat.

The slider 160 is supported within the discharge tube 120 by two rows of studs 136 which are of the "dog-point" type, each row containing five of the studs 136. The lower edges 161 of the slider 160 rest upon and are carried by the smooth shanks 139 of the studs 136. The radius of curvature of the outer surface of the slider 160 is slightly less than the radius of curvature of the inner surface 127 of the discharge tube 120 so that the outer surface of the slider 160 is spaced a few thousandths of an inch away from the inner surface 127 of the discharge tube 120. Preferably also, the threaded shanks 138 of the studs 136 extend inwardly beyond the inner surface 127 of the discharge tube 120 so as to center the slider 160 transversely with respect to the discharge tube 120. As a result of this construction, the outer surface of the slider 160 facing the inner surface 127 of the discharge tube 120 is spaced therefrom throughout the entire facing surface thereof.

An actuator mechanism 170 is provided to control the position and movement of the slider 160 within the discharge tube 120 and with respect to the openings 114 and 115 in the hopper cells 104 and 105, respectively. Referring to FIGS. 1 to 3, there is provided a handle 171 for the hopper 100, the handle 171 having a knob 172 at the end thereof that is disposed adjacent to the left-hand end of the hopper 100 and adjacent to the end coupling 126. The other end of the handle 171 is connected to a lever arm 174 that is fixedly connected to the outer end of a shaft 176 that extends transversely with respect to the hopper 100 and carries thereon an actuating lever 180, see FIG. 4. The shaft 176 is rotatable within a housing 184 mounted in a space at the bottom of the hopper 100 provided by two of the transverse walls 107. More specifically, a mounting plate 181 is provided on the top of the discharge tube 120 and is secured thereto as by welds, the mounting plate 181 having an opening therein that communicates with a slot 128 in the top of the discharge tube 120, see FIG. 5. The actuating lever 180 has a hub 187 receiving the shaft 176 therethrough, a pin 177 extending aligned openings in the hub 187 and the shaft 176 fixedly to secure the actuating lever 180 on the shaft 176. Access to the interior of the housing 184 is had through an opening that is closed by a threaded plug 189. There is provided a stop 178 extending inwardly from the side of the discharge tube 120 to limit longitudinal movement of the slider 160 into the discharge tube 120.

The slider 160 has a square hole 165 in its top center, see FIG. 4, that receives the actuating lever 180 extending downwardly thereinto. The actuating lever 180 can be oscillated by means of the actuator mechanism 170 including the knob 172, the lever arm 174 and the shaft 176 carrying the actuating lever 180. Thus by turning the shaft 176 about 45 degrees each way from its center position, the slider 160 is moved in one direction to uncover the discharge opening 114 for the hopper cell 104 or is moved in the other direction to uncover the discharge opening 115 for the hopper cell 105. It will be understood that the openings 114 and 115 can be fully uncovered by turning the shaft 176 a full 45 degrees or can be partially uncovered by turning the shaft 176 less than 45°.

In order to permit operation of the hopper 100 from either end thereof, the slider 130 has a second handle **141*a* pivotally connected to the lever arm 144 and extending to the right as viewed in FIGS. 3 and 4 to the adjacent end sleeve 121 where there is provided a knob 142*a*. Similarly the slider 160 is provided with a second handle 171*a* pivotally connected to the lever arm 174 and extending to the right end of the hopper as viewed in FIG. 3 to a point adjacent to the end sleeve 121, the outer end of the handle 171*a* carrying a knob 172*a***.

In order to close the end of the end sleeve 126, an end cap 190 is provided including a circular plate having a cylindrical flange 191 thereon that telescopically fits over the adjacent end of the end sleeve 126. Two clamps 192 are provided to hold the end cap 190 in covering and closing relationship with the end sleeve 126. Integrally secured to the end cap 190, such as by welding, is an angle bar 193 having a front flange 194 welded to the circular plate of the end cap 190.

The end sleeve 121 is also provided with an end cap such as the end cap 190 and the end cap for the end sleeve 121 has an angle bar mounted thereon such as the angle bar 193 and having a front flange 194 that engages the knobs **142*a* and 172*a*. When the end caps 190 are in the closing positions thereof, the flanges 194 are disposed in the paths of the associated knobs 142 and 172 and knobs 142*a* and 172*a*, thereby to hold the knobs 142 and 172 and the knobs 142*a* and 172*a* in the storage positions thereof, and consequently through the action of the handles 141 and 171 and the handles 141*a* and 171*a* to hold the sliders 130 and 160** in the storage positions thereof.

Referring to FIGS. 7 and 8 of the drawings it will be seen that the handle 141 is supported by a guide bracket 116 mounted on the bottom of the associated hopper cell 102. The bracket 116 has a key hole shaped slot 117 therein with the narrower portion 118 disposed downwardly and the enlarged portion 119 disposed upwardly. The handle 141 normally passes through and is engaged by the periphery of the narrow portion 118 and is slidably supported thereby. Disposed about the handle 141 and fixedly secured thereto is a collar 149, the collar 149 having a size such that it will not pass through the narrow portion 118, but having a size such that it can pass through the enlarged portion 119. During normal use of the handle 141, the extent of travel therefor is limited by the collar 149 contacting the guide bracket 116. When it is desired to remove the associated slide 130 from within the discharge tube 120, then the handle 141 is lifted to place the collar 149 in registry with the enlarged portion 119 of the slot 117 thus to permit further movement of the handle 141, all as will be described more fully hereinafter. The handle 171*a* is provided with a like bracket 116*a* and a collar 179*a* (see FIG. 3), operating as described above with respect to the bracket 116 and the collar 149. The handle 141*a* is supported by a guide bracket 116*a*, the handle 171 is supported by a guide bracket 116.

It is desirable when the end cap 190 is removed from the end sleeve 126 to keep the end cap off the ground so as to maintain it in a dry and clean condition. To this end a slide rod 197 is provided extending along a portion of the adjacent end of a hopper flange 101 and then around to the side thereof along a side portion 198, the ends of the slide rod 197 being suitably secured such as by rivets to the flange 101. A closed loop 196 extends around the slide rod 197 and is fixedly secured such as by welding to the angle bar 193. In this way, the end cap 190 is always mounted upon the hopper 100, even when removed from the end sleeve 126, the end cap 190 preferably being shifted to the side portion 198 as illustrated in FIG. 2 when it is removed from the end sleeve 126. There also is provided on the end cap 190 a strapping anchor 199 having an opening therethrough for receiving a metal strap so as to seal the end cap 190 in the closed position upon the end sleeve 126.

In the operation of the hopper 100, the handles 141 and 171 are moved so as to place the sliders 130 and 160 in the storage positions thereof as illustrated by solid lines in FIGS. 4 and 5 of the drawings. The end caps 190 are then placed in the closing positions thereof to close the open ends of the end sleeves 121 and 126. The hopper is then filled with granular material, such as plastic pellets, and transported to a desired unloading position.

In order to unload granular material from the hopper 100, it is necessary first to remove the end caps 190 and place each end cap on the side portion 198 associated therewith. This operation opens and renders accessible the end sleeves 121 and 126 for connection to one or more conduits for incorporation in a pressure or vacuum pneumatic conveying system. The knobs 142, 142*a*, 172 and 172*a* are also freed for operation of the sliders 130 and 160.

Referring particularly to FIGS. 4 and 5 of the drawings, if it is desired to unload material from the hopper 103 through the opening 113 and into the discharge tube 120, the knob 142 is pulled to the left as viewed in FIG. 4 which serves to pivot the lever arm 144 and the connected actuating lever 150 in a clockwise direction or to the left as viewed in FIG. 5. This serves to shift the slider 130 to the left so as at least partially to uncover the opening 113 to permit discharge of granular material from the hopper cell 103 into the discharge tube 120. Actually the slider 130 can be shifted longitudinally of the discharge tube 120 so as fully to clear the opening 113. The movement of the slider 130 is limited by the collar 149 fixedly positioned on the handle 141 and in position to contact the associated bracket 116 so long as the handle 141 is in the narrow portion 118 of the key hole slot 117. If on the other hand, it is desired to discharge material from the hopper cell 102 through the opening 112, the knob 142 is pushed to the right as viewed in FIG. 4 which pivots the lever arm 144 and the actuating lever 150 in a counterclockwise direction toward the right-hand dashed line position in FIG. 5. Such action at least partially uncovers the opening 112 by the shifting of the slider 130 longitudinally to the right. If it is desired fully to clear the opening 112, the slider 130 can be shifted to do so, the movement of the slider 130 being limited by a stop 168 extending inwardly from the wall of the discharge tube 120.

The slider 160 is operated in a manner identical to that described above with respect to the slider 130, the motion of the slider 160 being under the control of the handles 171 and 171*a* actuated by grasping the knobs 172 and 172*a;* the movement of the slider 160 to the right is limited by collar 179*a* on the handle 171*a* contacting bracket 116*a* and movement of the slider 160 to the left is limited by the stop 178. It will be appreciated therefore that two of the hopper cells 102 through 105 may be discharged simultaneously into the discharge tube 120, i.e., either one of the cells 102 or 103 may be discharged simultaneously with either one of the cells 104 or 105.

From the above it will be seen that either one of the sliders 130 or 160 may be conveniently operated from either end of the hopper 100. Movement of the sliders 130 and 160 is made easy due to the fact that the lower edges such as the edges 131 on the slider 130 make essentially only point contact with the smooth shanks 139 of the studs 136; also there is no contact between the outer surface of the slider 130 and the inner surface 127 of the discharge tube 120, and granular material does not tend to collect therebetween so as to bind or jam relative movement therebetween. Free movement of the sliders 130 and 160 is also facilitated by the fact that they are only part-circular in cross section, and the ends 134 are bevelled so as to move more readily through any body of granular material coming into contact therewith.

When discharge of the hopper 100 is completed, the 130 and 160 are returned to the storage positions thereof by use of the handles 141 or 141*a* and 171 or 171*a*. The end caps 190 can then be replaced in covering relationship with the end sleeves 121 and 126. This action places the angle bars 193 in covering relationship with respect to the knobs 142, 172, 142*a* and 172*a*, thus to hold the sliders 130 and 160 in the storage positions thereof during storage and transportation of the hopper 100.

If it is desired to remove one of the sliders, such as the slider 130, for repair or replacement, the handle 141 is lifted so as to align the associated collar 149 with the associated enlarged opening 119 to permit the collar to move therethrough which permits the slider 130 to shift far enough to clear the end of the actuating lever 150 from the opening 135 in the slider 130. This then permits the slider 130 to be moved longitudinally out of the discharge tube 120 for repair or replacement. When it is desired to insert the slider 130 into operative position, the slider 130 is returned to a position such that the actuating lever 150 can be reinserted in the opening 135, after which the slider 130 is shifted to the storage position thereof. Lowering of the handle 141 into the narrow position 118 will thereafter limit longitudinal sliding movement of the slider 130 so as to retain the actuating lever 150 in the opening 135. It will be appreciated that the slider 160 can be removed and replaced in the same manner as described above with respect to the slider 130.

From the above it will be seen that it is possible by means of the sliders 130 and 160 to stop the flow of lading from all of the hopper cells 102 through 105 and to permit flow from any one or two cells at a controlled rate, thus to achieve proper conveying of the lading through the discharge tube 120. Four hopper cells are controlled using only two sliders and the associated controls, control of the sliders 130 and 160 being from either end of the hopper 100. The sliders and the controls therefor are so constructed and arranged that the manually operated controls are placed on the outside of the hopper 100 and the discharge tube 120, yet the housings 154 and 174 and associated parts prevent leaking of air into or out of the discharge tube 120 through the actuator mechanisms 140 and 170 and also prevent the entry of dirt or water into the interior thereof.

Use of the "dog-point" studs 136 to provide sliding mounts for the sliders 130 and 160 positively prevents the studs from falling into the tube 120 to contaminate the lading. The diameter of the smooth shank 139 can be chosen to permit any desired vertical clearance between the slider 130 or 160 and the top of the tube 120, while the side clearance is controlled by permitting the threaded shanks 138 a few thousandths of an inch into the tube 120, thus the sliders 130 and 160 do not touch the interior surface 127 of the tube 120 at any point. By this construction, the bottom of the discharge tube 120 is clear of any moving parts thereby avoiding the possibility of the jamming or wedging of the lading particles between moving parts as occurs in prior art structures. Elimination of this region for accumulation of a prior foreign lading prevents contamination of the current lading by concealed particles of foreign lading. Far less force is required to move the relatively small sliders as compared to prior devices, and the mechanism is lighter in weight.

Each end sleeve 121 and 126 is covered during storage and transit by an end cap 190 to provide an airtight, water-tight and dust-tight closure therefor. The end caps 190 also through the angle bars 193 interlock with the controls for the actuator mechanisms 140 and 170 to insure that the controls are in the closed position when the end caps 190 are secured. In addition, when the end caps 190 are removed, they are retained by the slide rods 197 in such a way that they cannot drag in mud or debris, or even be lost if not properly replaced.

While there has been described what is at present considered to be the preferred embodiment of the invention, it will be understood that various changes and modifications may be made therein, and it is intended to cover in the appended claims all such modifications as fall within the true spirit and scope of the invention.

What is claimed is:

1. An unloading system for a hopper for holding granular lading comprising a hopper having a discharge opening in the lower portion thereof, a discharge tube disposed below said hopper and communicating intermediate its ends with the opening in said hopper for receiving granular lading from said hopper into said discharge tube, a part-tubular slider mounted within said discharge tube and adjacent to said opening, support structure carried by said discharge tube and extending inwardly therefrom and carrying the lower edges of said slider thereon to position said slider in the upper portion of said discharge tube, said slider being shiftable longitudinally within said discharge tube upon said support structure between a storage position covering said opening and a discharge position uncovering at least a portion of said opening, said slider in said storage position preventing discharge of granular lading from said hopper into said discharge tube and said slider in said discharge position permitting discharge of granular lading from said hopper into said discharge tube, and mechanism for moving said slider between said storage position and said discharge position.

2. The unloading system set forth in claim 1, wherein said support structure includes two rows of studs extending inwardly from the inner surface of said discharge tube.

3. The unloading system set forth in claim 1, wherein said discharge tube and said slider and said support structure are constructed and arranged so that said slider contacts only said support structure and is spaced a short distance from said discharge tube at all adjacent surfaces.

4. An unloading system for a hopper for holding granular lading comprising a hopper having a discharge opening in the lower portion thereof, a discharge tube disposed below said hopper and communicating intermediate its ends with the opening in said hopper for receiving granular lading from said hopper into said discharge tube, a part-tubular slider mounted within said discharge tube and confined in the upper portion thereof and adjacent to said opening, said slider being shiftable longitudinally within said discharge tube among a storage position covering said opening and a discharge position uncovering at least a portion of said opening and a removal position, and mechanism connected to said slider for moving said slider among said storage position and said discharge position and said removal position, said mechanism extending transversely of said slider for engagement therewith in the storage position thereof for preventing discharge of granular lading from said hopper into said discharge tube, said mechanism extending obliquely with respect to said slider for engagement therewith in the discharge position thereof for permitting discharge of granular lading from said hopper into said discharge tube, said mechanism being disposed out of the path of said slider and out of engagement therewith in the removal position thereof to permit removal of said slider from said discharge tube.

5. An unloading system for hoppers for holding granular lading comprising a hopper having at least two separate cells with each cell having a discharge opening in the lower portion thereof, a discharge tube disposed below said hopper and communicating intermediate its ends with both said cells for receiving granular lading from said hopper into said discharge tube, a part-tubular slider mounted within said discharge tube and confined in the upper portion thereof and adjacent to said openings, said slider being shiftable longitudinally within said discharge tube among a storage position covering both said openings and a first discharge position uncovering at least a portion of only one of said openings and a second discharge position uncovering at least a portion of only said other opening, said slider in said storage position preventing discharge of granular lading from said hopper into said discharge tube and said slider in said discharge positions permitting discharge of granular lading respectively from the associated hopper cells into said discharge tube, and mechanism for moving said slider among said storage position and said discharge positions.

6. The unloading system set forth in claim 5, wherein said discharge tube has circular cross section, and said slider is part-circular in cross section.

7. The unloading system set forth in claim 5, wherein said mechanism includes an actuating lever pivotally mounted on said hopper and engaging said slider, and a handle operatively connected to said actuating lever and manually shiftable to pivot said actuating lever and thus to move said slider between said storage position and said discharge positions.

8. An unloading system for a hopper for holding granular lading comprising a hopper having at least two separate cells each having a discharge opening in the lower portion thereof, a discharge tube disposed below said hopper and communicating intermediate its ends with both said openings in said hopper for receiving granular lading from said hopper cells into said discharge tube, two part-tubular sliders mounted within said discharge tube in general longitudinal alignment and respectively adjacent to said openings, support structure carried by said discharge tube and extending inwardly thereof and carrying the lower edges of said sliders thereon to position said sliders in the upper portion of said discharge tube, said sliders being independently shiftable longitudinally within said discharge tube upon said support structure between a storage position covering the associated opening and a discharge position uncovering at least a portion of the associated opening, each of said sliders in the storage position thereof preventing discharge of granular lading from said hopper into said discharge tube through the associated opening and each of said sliders in the discharge position thereof permitting discharges of granular lading from the associated hopper cell into said discharge tube through the associated opening, and mechanisms for independently moving said sliders between said storage positions and said discharge positions.

9. The unloading system set forth in claim 8, wherein said discharge tube has a circular cross section, and each of said sliders is part-circular in cross section.

10. The unloading system set forth in claim 8, wherein said support structure includes two rows of studs extending inwardly from the inner surface of said discharge tube.

11. The unloading system set forth in claim 8, wherein each of said mechanism includes an actuating lever pivotally mounted on said hopper and engaging the associated slider, and a handle operatively connected to each of said actuating levers and manually shiftable to pivot the associated actuating lever and thus to move the associated slider between said storage position and said discharge position.

12. An unloading system for a hopper for holding granular lading comprising a hopper having at least four separate cells with each cell having a discharge opening in the lower portion thereof, a discharge tube disposed below said hopper and communicating intermediate its ends with all of said openings in said hopper cells for receiving granular lading from said hopper cells into said discharge tube, two part-tubular sliders mounted within said discharge tube in general longitudinal alignment and confined in the upper portion thereof and respectively adjacent to said openings, each of said sliders being independently shiftable longitudinally within said discharge tube among a storage position covering two of the associated openings and a first discharge position uncovering at least a portion of only one of the two associated openings and a second discharge position uncovering at least a portion of only the other of the two said associated openings, each of said sliders in the storage position thereof preventing discharge of granular lading from both of the associated hopper cells into said discharge tube and each of said sliders in the first discharge position thereof permitting discharge of granular lading from only the said one associated hopper cell into said discharge tube and in the second discharge position permitting discharge of granular lading from only said associated other hopper cell into said discharge tube, and mechanisms for independently moving said sliders among said storage positions and said discharge positions.

13. The unloading system set forth in claim 12, wherein said discharge tubes has a circular cross section, and each of said sliders is part-circular in cross section.

14. The unloading system set forth in claim 12, wherein each of said mechanisms includes an operating handle mounted adjacent to one end of said discharge tube and connected to the associated slider for moving said associated slider between the storage position and the discharge position thereof.

15. The unloading system set forth in claim 14, and further comprising an end cap for said one end of said discharge tube securable thereto for closing said one end of said discharge tube, said end cap including means to assist in holding said handles in positions to maintain said sliders in the storage positions thereof when said end cap is secured in position for closing said one end of said discharge tube.

16. An unloading system for a hopper for holding granular lading comprising a hopper having a discharge opening in the lower portion thereof, a discharge tube disposed below said hopper and having one end adjacent to one end of said hopper and communicating intermediate its ends with the opening in said hopper for receiving granular lading from said hopper, a part-tubular slider mounted within said discharge tube and confined in the upper portion thereof and adjacent to said opening, said slider being shiftable longitudinally within said discharge tube between a storage position covering said opening and a discharge position uncovering at least a portion of said opening, said slider in said storage position preventing discharge of granular lading from said hopper into said discharge tube and said slider in said discharge position permitting discharge of granular lading from said hopper into said discharge tube, an operating handle mounted adjacent to said one end of said discharge tube and said hopper and connected to said slider for moving said slider between said storage position and said discharge position, an end cap for said one of said discharge tube securable thereto for closing said one end of said discharge tube, said end cap including means for holding said handle in a position to maintain said slider in the storage position thereof when said end cap is secured in position for closing said one end of said discharge tube, and a rod fixedly mounted on said hopper and extending transversely thereof along the adjacent end thereof and longitudinally along one side thereof and slidably coupled to said end cap to support said end cap on said hopper, whereby upon disengagement of said end cap with respect to said discharge tube said end cap may be supported by and slid along said rod to a point alongside said hopper well away from said one end of said discharge tube.

17. An unloading system for hoppers for holding granular lading comprising a hopper having at least two separate cells with each cell having a discharge opening in the lower portion thereof, a discharge tube disposed below said hopper and communicating intermediate its ends with both said cells for receiving granular lading from said hopper into said discharge tube, a part-tubular slider mounted within said discharge tube and confined in the upper portion thereof and adjacent to said openings, two rows of studs carried by said discharge tube and extending inwardly from the inner surface thereof and carrying the lower edges of said slider thereon for supporting said slider within said discharge tube, said slider being shiftable longitudinally within said discharge tube among a storage position covering both said openings and a first discharge position uncovering at least a portion of only one of said openings and a second discharge position uncovering at least a portion of only said other opening, said slider in said storage position preventing discharge of granular lading from said hopper into said discharge tube and said slider in said discharge positions permitting discharge of granular lading respectively from the associated hopper cells into said discharge tube, and mechanism for moving said slider among said storage position and said discharge position.

18. An unloading system for a hopper for holding granular lading comprising a hopper having at least four separate cells with each cell having a discharge opening in the lower portion thereof, a discharge tube disposed below said hopper and communicating intermediate its ends with all of said openings in said hopper cells for receiving granular laading from said hopper cells into said discharge tube, two rows of studs carried by said discharge tube and extending inwardly from the inner surface thereof, two part-tubular sliders mounted upon said two rows of studs within said discharge tube in general longitudinal alignment and confined in the upper portion of said discharge tube and respectively adjacent to said openings, each of said sliders being independently shiftable longitudinally within said discharge tube among a storage position covering two of the associated openings and a first discharge position uncovering at least a portion of only one of the two associated openings and a second discharge position uncovering at least a portion of only the other of the two said associated openings, each of said sliders in the storage position thereof preventing discharge of granular lading from both of the associated hopper cells into said discharge tube and each of said sliders in the first discharge position thereof permitting discharge of granular lading from only said one associated hopper cell into said discharge tube and in the second discharge position permitting discharge of granular lading from only the other of said associated hopper cells into said discharge tube, and mechanisms for independently moving said sliders among said storage positions and said discharge positions.

19. An unloading system for a hopper for holding granular lading comprising a hopper having a discharge opening in the lower portion thereof, a discharge tube disposed below said hopper and communicating intermediate its ends with the opening in said hopper for receiving granular lading from said hopper into said discharge tube, a valve having a storage position preventing discharge of granular lading from said hopper into said discharge tube and a discharge position permitting discharge of granular lading from said hopper into said discharge tube, mechanism including a handle adjacent to each end of said discharge tube for operating said valve between said storage position and said discharge position, end caps for said ends of said discharge tube securable thereto for closing said ends of said discharge tube, each of said end caps including means for holding said handle in a position to maintain said valve in the storage position thereof when said end cap is secured in position for closing the associated end of said discharge tube, and rods fixedly mounted on said hopper and respectively extending transversely thereof along the adjacent end thereof and longitudinally along one side thereof and slidably coupled to the associated ones of said end caps to support said end caps on said hopper, whereby upon disengagement of said end caps with respect to said discharge tube said end caps may be supported by and slid along said rods to points alongside said hopper well away from said ends of said discharge tube.

* * * * *